US011846285B2

(12) United States Patent
Cangioli et al.

(10) Patent No.: US 11,846,285 B2
(45) Date of Patent: Dec. 19, 2023

(54) PUMP WITH A BEARING LUBRICATION SYSTEM

(71) Applicant: NUOVO PIGNONE TECNOLOGIE—S.R.L., Florence (IT)

(72) Inventors: Francesco Cangioli, Florence (IT); Matteo Berti, Florence (IT); Alessandro Musacchio, Florence (IT); Leonardo Tognarelli, Florence (IT)

(73) Assignee: Nuovo Pignone Tecnologie—S.R.L, Florence (IT)

( * ) Notice: Subject to any disclaimer, the term of this patent is extended or adjusted under 35 U.S.C. 154(b) by 214 days.

(21) Appl. No.: 17/310,024

(22) PCT Filed: Jan. 14, 2020

(86) PCT No.: PCT/EP2020/025013
§ 371 (c)(1),
(2) Date: Jul. 12, 2021

(87) PCT Pub. No.: WO2020/148091
PCT Pub. Date: Jul. 23, 2020

(65) Prior Publication Data

US 2022/0099089 A1 Mar. 31, 2022

(30) Foreign Application Priority Data

Jan. 15, 2019 (IT) ..... 102019000000637

(51) Int. Cl.
*F04D 29/18* (2006.01)
*F04D 13/06* (2006.01)
(Continued)

(52) U.S. Cl.
CPC ..... *F04C 15/0088* (2013.01); *F04C 2/16* (2013.01); *F04D 3/02* (2013.01); *F04D 29/181* (2013.01);
(Continued)

(58) Field of Classification Search
CPC ..... F04D 13/0646; F04D 3/00; F04D 3/02; F04C 15/0088; F04C 2/16
See application file for complete search history.

(56) References Cited

U.S. PATENT DOCUMENTS 5,997,264 A 12/1999 Klein et al.
6,084,328 A 7/2000 Yamashita et al.
(Continued)

FOREIGN PATENT DOCUMENTS

EP 3239543 A1 11/2017
FR 1039613 A 10/1953

*Primary Examiner* — Deming Wan
(74) *Attorney, Agent, or Firm* — Paul Frank + Collins P.C.

(57) ABSTRACT

The pump comprises a casing; a statoric part stationarily housed in the casing; at least one impeller arranged for rotation in the casing. A process fluid path extends though the statoric part and the impeller. A bearing rotatingly supports the impeller in the casing and a bearing lubrication path is provided, to circulate a fluid flow through the bearing. A rotary screw integral with the impeller and rotating therewith when the pump is operating provides a pumping action on process fluid such that rotation of the impeller promotes process fluid circulation by means of said rotary screw through the bearing lubrication path.

8 Claims, 3 Drawing Sheets

(51) Int. Cl.

| | |
|---|---|
| ***F04D 3/00*** | (2006.01) |
| ***F04D 3/02*** | (2006.01) |
| ***F04C 15/00*** | (2006.01) |
| ***F04C 2/16*** | (2006.01) |

(52) U.S. Cl.
CPC ..... *F04C 2240/30* (2013.01); *F04C 2240/50* (2013.01)

(56) References Cited

U.S. PATENT DOCUMENTS

| | | | | |
|---|---|---|---|---|
| 2010/0266230 | A1 | 10/2010 | Hong | |
| 2016/0177962 | A1* | 6/2016 | Laing | F04D 29/061 417/423.13 |
| 2017/0159665 | A1 | 6/2017 | Bergamini et al. | |
| 2018/0087516 | A1 | 3/2018 | Osama et al. | |
| 2023/0044524 | A1* | 2/2023 | Russalian | F04D 13/026 |

* cited by examiner

PUMP WITH A BEARING LUBRICATION SYSTEM

TECHNICAL FIELD

The present disclosure concerns improvements to pumps. More specifically, the disclosure concerns rotodynamic pumps comprising one or more impellers arranged in a casing, and including bearings rotatingly supporting the impellers in the casing.

BACKGROUND ART

Rotodynamic pumps are used in a variety of applications for transferring energy to a process fluid by means of one or more rotating impeller.

As known to those skilled in the art, dynamic pumps or rotodynamic pumps are machines wherein a fluid is pressurized by transferring kinetic energy, typically from a rotating element such as an impeller, to the fluid being processed through the pump.

Some pumps are designed for processing a multi-phase fluid, containing a liquid phase and a gaseous phase. Some pumps include embedded electric motors, which rotate each impeller and which can be adapted to control the rotational speed of each impeller independently of the other impellers of the pump, for instance in order to adapt the rotational speed to the actual gas/liquid ratio in each pump stage. Embodiments of multi-phase pumps with embedded electric motors are disclosed for instance in US2017/0159665.

Pump impellers are supported on a stationary shaft by means of bearings, for example polycrystalline diamond (PCD) bearings, which are provided with bearing pads made of or including synthetic diamond. Bearings require continuous lubrication for reducing friction and remove heat therefrom. Complex bearing lubrication circuits are provided for circulating a lubricant through the bearings of the pump impellers. An external lubrication pump is required to circulate the lubrication fluid in the lubrication circuit and through the bearings. Lubrication circuits add to the complexity of the rotodynamic pumps, increase the cost and dimensions of the pumps and may reduce the pump availability, since the lubrication circuit and the relevant lubrication pumps may be prone to malfunctioning.

A need therefore exists to provide simpler and less expensive systems to lubricate bearings in a pump, in particular a rotodynamic pump with embedded electric motors for rotating the impellers.

SUMMARY

According to one aspect of the present disclosure a rotodyamic pump is provided, having a casing, wherein a statoric part and at least one impeller are housed. The impeller is supported on at least one bearing for rotation in the casing. A process fluid path extends through the statoric part and the impeller of the pump. A bearing lubrication path is further provided, for circulating a fluid flow through the bearing. A small portion of the main process fluid flow is diverted from the process fluid path towards the bearing, for bearing lubricating and/or refrigerating purposes.

A screw pump is provided for circulating the fluid through the bearing. The screw pump is formed by a stationary surface integral with the statoric part of the rotodynamic pump, and a rotary screw integral with the impeller of the rotodynamic pump and rotating therewith. The stationary surface and the rotary screw are arranged coaxial to one another and face one another to form the screw pump.

The screw pump is fluidly coupled to the process fluid path and to the bearing lubrication path, such that rotation of the impeller causes a small flowrate of process fluid to be diverted from the main process fluid path into the bearing lubrication path, through the bearing, and back into the main process fluid path.

In embodiments disclosed herein, the screw pump can include two or more screw pump sections, each including a portion of the stationary surface integral with the statoric part of the pump, and a portion of the rotary screw, integral with the impeller and rotating therewith. For instance, a screw pump section can be arranged at an inlet of the bearing lubrication path and a further screw pump section can be arranged at an outlet of the bearing lubrication path. The inlet and the outlet of the bearing lubrication path can be defined by annular gaps between the impeller and the statoric part of the pump. The inlet gap can be arranged downstream of the impeller and the outlet gap can be arranged upstream of the impeller. As used herein, the terms "upstream" and "downstream" are referred to the direction of flow of the process fluid.

The screw pump sections replace usual sealing arrangements along gaps between the rotary impeller and the statoric part of the pump. The screw pump thus provides a controlled fluid flow from the inlet gap, through the bearing lubrication path, and back to the main process fluid path through the outlet gap.

In some embodiments the stationary surface can be smooth, for instance can include a smooth cylindrical surface. In other embodiments, the stationary surface can be formed as a stationary screw, i.e. can feature a screw profile. In the same pump a combination of stationary smooths cylindrical surfaces and stationary screw-shaped surfaces can be combined in different sections of the same screw pump.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION

A novel and useful lubrication system has been developed, to improve lubrication and cooling of bearings in a rotodyamic pump. The bearing lubrication system uses the same fluid processed by the rotodyamic pump to lubricate and cool the impeller bearing. This can be particularly beneficial in case of pumps for the oil and gas industry, where the process fluid comprises a mixture of hydrocarbons, and which may comprise a multiphase (liquid/gas) mixture of hydrocarbons. The lubrication system can comprise a bearing lubrication path for each bearing. A small portion of the process fluid pumped by the impeller is diverted from the process fluid flow and is used to lubricate and refrigerate the bearing. The diverted fluid is guided along the lubrication path and flows through the bearing, in particular between rotary and stationary members of the bearing, thus reducing friction between stationary component and rotary component and refrigerating the bearing.

The side flow of process fluid used to lubricate the bearing is pumped through the bearing lubrication path by a positive displacement pump formed by the impeller and by a statoric part co-acting with the impeller. Specifically, in embodiments disclosed herein, the positive displacement pump is a screw pump formed by one or more screws arranged in gaps between the impeller and the statoric part of the pump.

The screw pumps promote the flow of process fluid for cooling and lubrication purposes through the bearing(s) and can also promote removal of solid contaminants from the cavity where the bearing(s) are housed.

Figure 1:
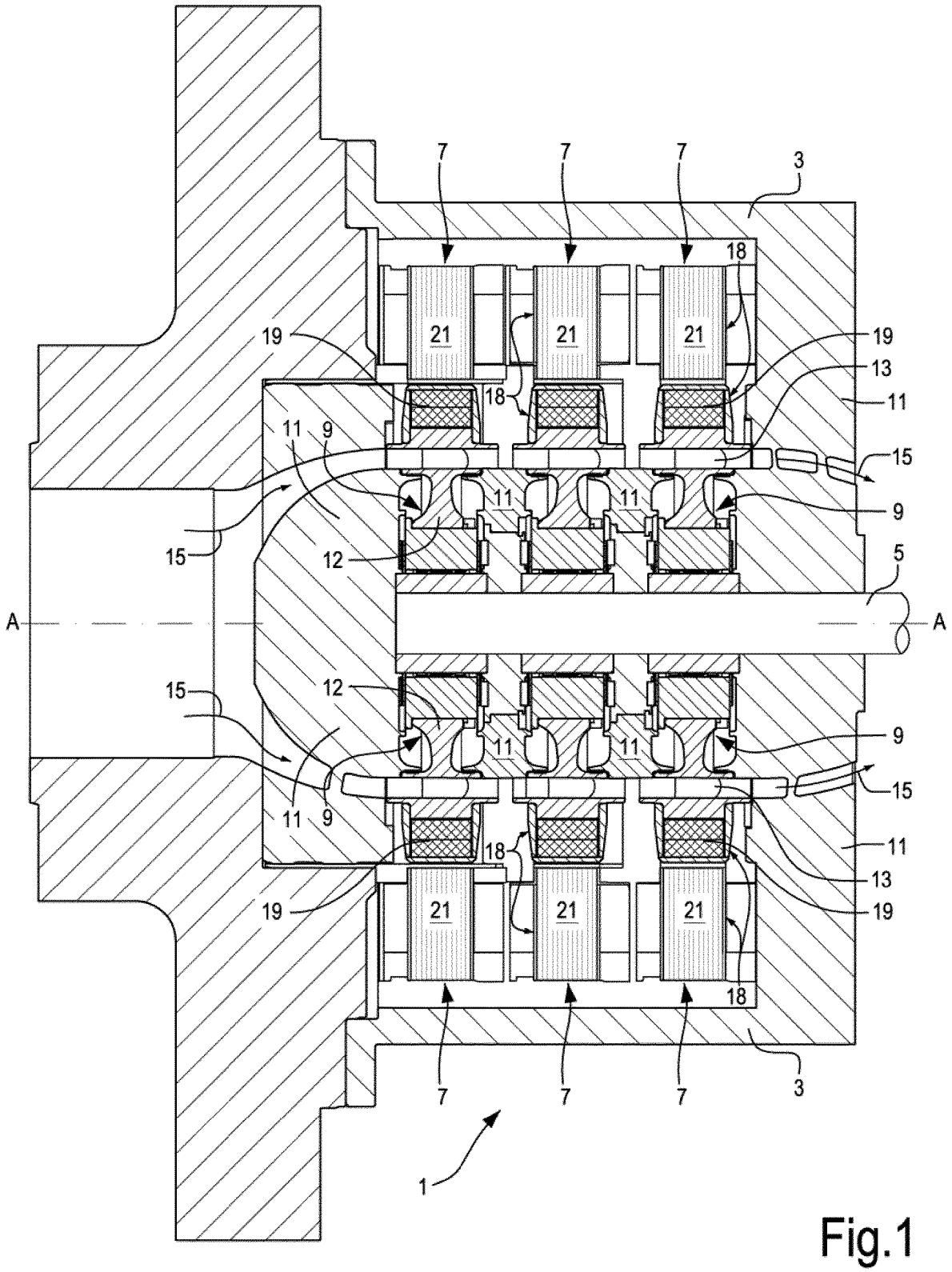
FIG. 1 shows a cross-sectional view of a multi-stage rotodynamic pump including embedded electric motors to drive the pump impellers.

Referring now to FIG. 1, a rotodynamic pump 1 comprises a casing 3 and a stationary shaft 5 arranged therein. The pump can comprise a plurality of stages 7. Each pump stage 7 comprises a respective impeller 9, which is supported for rotation on the shaft 5 and co-acts with a statoric part 11, i.e. with a non-rotating, stationary component of the pump.

Figure 2:
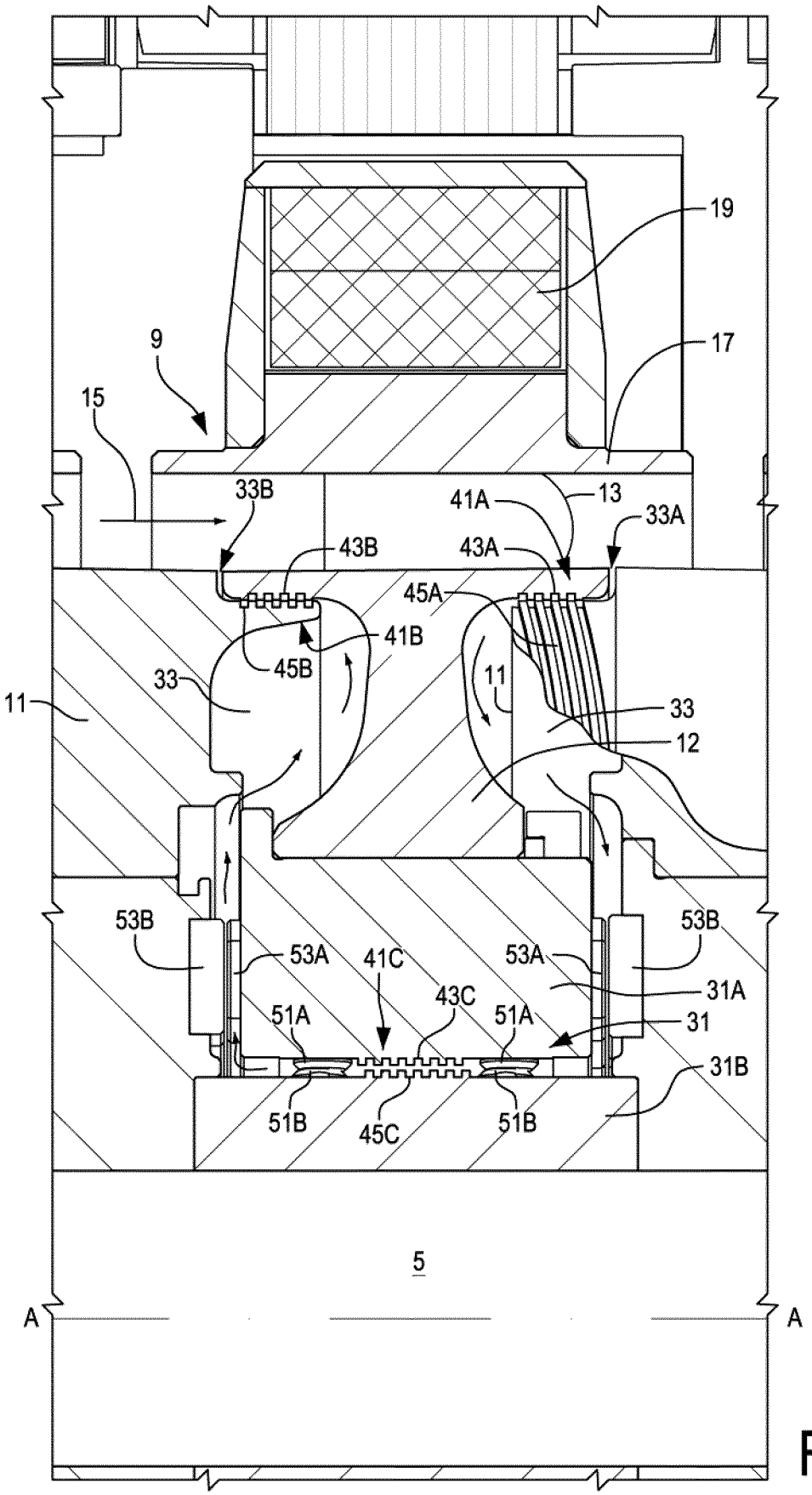
FIG. 2 shows an enlargement of one impeller of the pump of FIG. 1 and relevant bearing lubrication circuit.

Referring now to FIG. 2, with continuing reference to FIG. 1, each impeller 9 comprises a disc-shaped body 12 and a plurality of blades 13 distributed annularly around a rotation axis A-A. A process fluid path 15 extends across the bladed portion of each impeller 9. Mechanical power generated by embedded electric motors, to be described, rotate the impellers 9, which transfer the power to the process fluid along the process fluid path 15 to boost the pressure of the fluid.

In the exemplary embodiment of FIGS. 1 and 2, each impeller 9 comprises a shroud 17. Each impeller 9 is driven into rotation by a respective electric motor 18 housed in the casing 3. Each electric motor 18 includes a rotor 19, arranged around the shroud 17 and rotating with the impeller 9, as well as a stator 21 developing around the rotor 19 and stationarily housed in the casing 3.

Each impeller 9 is supported on the stationary shaft 5 by means of a respective bearing 31, for instance a PCD (Poly-Crystalline Diamond) bearing. Each bearing 31 is arranged along a bearing lubrication path 33, formed between the statoric part 11 and the impeller 9. More precisely, each bearing lubrication path 33 extends from an inlet 33A to an outlet 33B. The inlet 33A and outlet 33B are both formed by a respective annular gap extending around the rotation axis A-A of the impeller 9. Each annular gap is formed between the respective impeller 9 and the statoric part 11.

At the inlet gap 33A and outlet gap 33B of the bearing lubrication path 33 a screw pump is provided, which circulates a portion of the process fluid, diverted from the process fluid path 15 downstream of the impeller 9, through the bearing lubrication path 33, through the bearing 31 and back into the process fluid path upstream of the impeller 9.

More specifically, in the embodiment of FIGS. 1 and 2 the screw pump comprises a first screw pump section 41A at the inlet gap 33A of the bearing lubrication path 33, and a second screw pump section 41B at the outlet gap 33B of the bearing lubrication path 33. The two screw pump sections 41A, 41B replace sealing arrangements usually used to seal the bearing 31 of the impeller 9 from the process fluid path. More in detail, in the embodiment of FIGS. 1 and 2, the first screw pump section 41A comprises a rotary screw 43A formed on a substantially cylindrical surface of the impeller 9. The rotary screw 43A faces a stationary screw 45A formed on a substantially cylindrical surface of the statoric part 11. Similarly, the second screw pump section 41B comprises a rotary screw 43B formed on a substantially cylindrical surface of the impeller 9. The rotary screw 43B faces a stationary screw 45B formed on a substantially cylindrical surface of the statoric part 11.

Thus, each screw pump section is comprised of two facing screws, a stationary one and a rotary one. In other currently less preferred and less efficient embodiments, each screw pump section may comprise a single screw, co-acting with a smooth cylindrical surface, as will be described in more detail later on.

When the impeller 9 rotates, the facing screws 43A, 45A and 43B, 45B positively displace a portion of the process fluid from the process fluid path 15 in the bearing lubrication path 33. A small, controlled flowrate of the process fluid is thus diverted from the main process fluid path and is used to lubricate the bearing 31 which is arranged along the bearing lubrication path. In addition to a lubrication effect, the diverted process fluid flow can also remove friction-generated heat from the bearing 31, thus refrigerating the bearing 31 and preventing overheating thereof. The shape of the facing screws 43A, 45A and 43B, 45B is such that only a small, controlled amount of process fluid is diverted from the main path and caused to flow through the respective bearing 31.

Since the annular inlet gap 33A of the bearing lubrication path 33 is arranged downstream of the impeller 9 and the annular outlet gap 33B of said path 33 is arranged upstream of the impeller 9, the pressure difference between the downstream side and upstream side of the impeller 9 is used, in combination with the pumping effect of the screw pump, to promote the fluid flow through the bearing lubrication path 33 and through the bearing 31. The combined pressure drop between downstream and upstream sides of the impeller 9 and the pressurizing action of the screw pump overcome the pressure losses of the lubrication fluid flowing through the bearing lubrication path 33 and through the meatus between the rotary part 31A and the stationary part 31B of the bearing 31.

By providing two screw pump sections 41A, 41B at the inlet gap 33A and at the outlet gap 33B of the bearing lubrication path 33 efficient and balanced fluid flow is obtained. In other, currently less preferred embodiments, the screw pump can include a single pump section, for instance only the inlet screw pump section 41A or the outlet screw pump section 41B. Using two screw pump sections at both ends of the bearing lubrication path 33 a more balanced lubrication flow is obtained, in combination with a better control of the actual flow rate through the inlet gap 33A and the outlet gap 33B.

In some embodiments, an additional screw pump section 41C can be provided in the bearing 31. More specifically, a rotary screw 43C can be provided on an inner cylindrical surface of the rotary member 31A of the bearing 31 and a stationary screw 45C can be provided on the outer cylindrical surface of the stationary member 31B of the bearing 31. The facing screws 43C, 45C form a third section of the screw pump and facilitate the circulation of the lubricating process fluid flowing through the bearing 31. In other, currently less advantageous embodiments, either one or the other of the inner cylindrical surfaces of the rotary member 31A of the bearing and outer cylindrical surface of the stationary bearing member 31B can dispensed with. A double, facing screw arrangement as disclosed in FIGS. 1 and 2 provides more efficient pumping of the process fluid through the bearing lubrication path 33.

In the embodiment of FIGS. 1 and 2 each bearing 31 is a PCD bearing comprised of radial bearing pads 51A on the rotary member 31A and radial bearing pads 51B on the stationary member 31B. The screws 43C, 45C can be arranged between the bearing pads 51A, 51B. Each bearing 31 can further include axial bearing pads 53A on the rotary bearing member 31A and axial bearing pads 53B on the stationary bearing member or on the statoric part 11 of the pump 1.

During operation, the impellers 9 are driven into rotation by the respective electric motors 18. Process fluid is pumped along the process fluid path 15 by the impellers 9 at increasing pressure from the most upstream to the most downstream impeller. In the gap 33A downstream each impeller 9 a small process fluid flowrate is diverted from the main flow by the screw pump section 41A and pumped into the bearing lubrication path 33, through the bearing 31 and finally removed from the bearing lubrication path 33 through the screw pump section 41B and returned in the main process fluid path 15 through the outlet gap 33B. If present, the screw pump section 41C promotes displacement of the lubricating process fluid across the bearing 31.

A novel bearing lubrication system is thus obtained by replacing the usual seals between the impellers 9 and the statoric part 11 of the pump with screw pump sections 41A, 41B. The screw pump arranged adjacent the gaps 33A, 33B, which place the bearing lubrication path 33 in fluid communication with the main process fluid path 15, generate a controlled process fluid flowrate through the bearings 31 for lubrication and refrigeration purposes. Efficient lubrication and refrigeration of the bearings 31 is thus achieved, without the need for special lubrication ducts and external lubrication pumps. Lubricant is pumped through the bearings by the impellers 9 of the rotodyamic pump, with the aid of the positive displacement pumps formed by the screw pump sections at each gap 33A, 33B.

Figure 3:
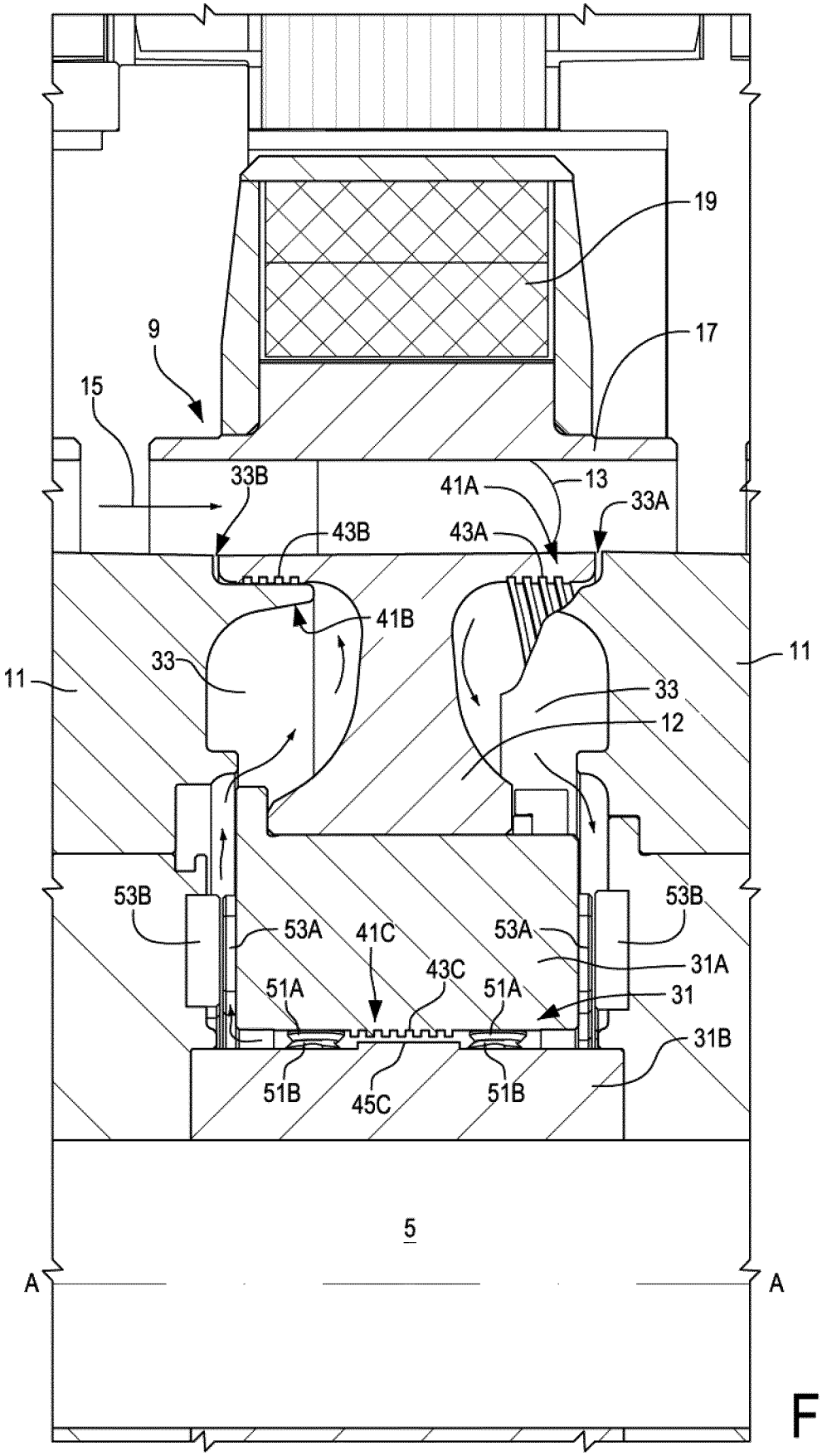
FIG. 3 shows an enlargement similar to FIG. 2 in a second embodiment.

FIG. 3 illustrates an enlargement similar to FIG. 2 of a further embodiment of the pump according to the present disclosure. The same elements, parts or components already shown in FIGS. 1 and 2 and described above are labeled with the same reference numbers and are not described again. The main difference between the embodiment of FIG. 3 with respect to the embodiment of FIG. 2 is that each screw profile 43A, 43B and 43C provided on the rotary impeller 9 faces a smooth opposing cylindrical surface, rather than an opposing screw profile. In this embodiment, therefore, each screw pump section is a single-screw pump section.

In further embodiments, not shown, a combination of the embodiments of FIGS. 2 and 3 can be provided.

While the invention has been described in terms of various specific embodiments, it will be apparent to those of ordinary skill in the art that many modifications, changes, and omissions are possible without departing form the spirit and scope of the claims. In addition, unless specified otherwise herein, the order or sequence of any process or method steps may be varied or re-sequenced according to alternative embodiments.

The invention claimed is:

1. A pump, comprising:

a casing;

a stationary component housed in the casing, the stationary component having a cylindrical surface forming a stationary screw;

an impeller arranged for rotation in the casing;

a process fluid path extending though formed between the stationary component and the impeller;

a bearing adapted to rotatingly support the impeller in the casing;

a bearing lubrication path adapted to circulate a fluid flow through the bearing; and a rotary screw integral with the impeller and rotating therewith when the pump is operating;

wherein the rotary screw is arranged coaxial to and engages with a stationary surface of the statoric part-and stationary screw of the stationary component to form a screw pump, which is fluidly coupled to the process fluid path and to the bearing lubrication path so that rotation of the impeller circulates process fluid circulation through the bearing lubrication path.

2. The pump of claim 1, wherein the bearing lubrication path extends from an inlet, fluidly coupled to the process fluid path downstream of the impeller, to an outlet, fluidly coupled to the process fluid path upstream of the impeller.

3. The pump of claim 2, wherein the inlet of the bearing lubrication path includes an annular gap extending around a rotation axis of the impeller.

4. The pump of claim 2, wherein the outlet of the bearing lubrication path includes an annular gap extending around the rotation axis of the impeller.

5. The pump of claim 2, wherein the rotary screw has a first rotary screw portion at the inlet of the bearing lubrication path and a second rotary screw portion at the outlet of the bearing lubrication path and wherein the first rotary screw portion forms a first screw pump section and the second rotary screw portion forms a second screw pump section.

6. The pump of claim 5, wherein the rotary screw has a third rotary screw portion intermediate the inlet and the outlet of the bearing lubrication path and wherein the third rotary screw portion forms a third screw pump section.

7. The pump of claim 6, wherein the third rotary screw portion is formed on said bearing.

8. The pump of claim 1, wherein the bearing comprises polycrystalline diamond bearing pads.

* * * * *